US011077686B2

(12) United States Patent
Sue

(10) Patent No.: US 11,077,686 B2
(45) Date of Patent: Aug. 3, 2021

(54) HEAD ASSEMBLY AND INKJET RECORDING APPARATUS

(71) Applicant: KYOCERA Document Solutions Inc., Osaka (JP)

(72) Inventor: Tomohiro Sue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/752,905

(22) Filed: Jan. 27, 2020

(65) Prior Publication Data

US 2020/0247156 A1 Aug. 6, 2020

(30) Foreign Application Priority Data

Jan. 31, 2019 (JP) ..... JP2019-015559

(51) Int. Cl.
*B41J 25/00* (2006.01)

(52) U.S. Cl.
CPC ..... *B41J 25/001* (2013.01)

(58) Field of Classification Search
CPC ..... B41J 2/16585; B41J 2/16517; B41J 2/16505; B41J 2/16535; B41J 2/2146; B41J 2/2103; B41J 2/01; B41J 2/145; B41J 2/16588; B41J 2/2139; B41J 2/15; B41J 2/51; B41J 2/512; B41J 15/10; B41J 15/12; B41J 19/1424; B41J 25/001; B41J 25/003; B41J 25/304; B41J 25/34; B41J 2002/16576; B41J 25/3082; B41J 25/3086; B41J 25/3088
See application file for complete search history.

(56) References Cited

FOREIGN PATENT DOCUMENTS

EP 0440469 * 1/1991 ..... B41J 25/304
JP 2008-296518 A 12/2008

* cited by examiner

*Primary Examiner* — Kristal Feggins
(74) *Attorney, Agent, or Firm* — Studebaker & Brackett PC

(57) ABSTRACT

A head assembly includes a base member, a recording head, a coupling member, and a pressing member. The recording head ejects ink. The coupling member couples the recording head to the base member. The pressing member is in contact with a first surface of the recording head. The coupling member includes an urging member that urges a second surface of the recording head toward the first surface of the recording head. The second surface of the recording head is a surface of the recording head on an opposite side from the first surface.

12 Claims, 10 Drawing Sheets

HEAD ASSEMBLY AND INKJET RECORDING APPARATUS

INCORPORATION BY REFERENCE

The present application claims priority under 35 U.S.C. § 119 to Japanese Patent Application No. 2019-015559, filed on Jan. 31, 2019. The contents of this application are incorporated herein by reference in their entirety.

BACKGROUND

The present disclosure relates to a head assembly and an inkjet recording apparatus.

A linehead type inkjet recording apparatus is one type of inkjet recording apparatus. The linehead type inkjet recording apparatus includes a recording head. The linehead type inkjet recording apparatus conveys a recording medium and ejects ink from the recording head toward the recording medium being conveyed, thereby recording an image on the recording medium. The recording head includes a nozzle surface in which multiple nozzle orifices that allow ink to be ejected therefrom are formed.

In general, the linehead type inkjet recording apparatus includes a head assembly including recording heads. The recording heads are arranged in a width direction of a recording medium. Here, the width direction is perpendicular to a conveyance direction of the recording medium. The linehead type inkjet recording apparatus is also configured to eject ink of the same color (one color) from each of the recording heads of the one head assembly. A linehead type inkjet recording apparatus for color printing therefore includes for example four head assemblies. Specifically, this inkjet recording apparatus includes a main body equipped with respective head assemblies for yellow, cyan, magenta, and black colors. The head assemblies for the different colors are arranged side by side in the conveyance direction of the recording medium.

What is needed in the linehead type inkjet recording apparatuses is a more accurate positioning of the recording heads. For example, the recording heads need to be positioned so that respective nozzle surfaces of the recording heads are parallel to a conveyance surface which allows the recording medium to be conveyed thereon. This is because the respective nozzle surfaces of the recording heads being not parallel to the conveyance surface may result in a decline in image quality. That may lead to for example deviation of image density from desired density.

SUMMARY

A head assembly according to an aspect of the present disclosure includes a base member, a recording head, a coupling member, and a pressing member. The recording head ejects ink. The coupling member couples the recording head to the base member. The pressing member is in contact with a first surface of the recording head. The coupling member includes an urging member that urges a second surface of the recording head toward the first surface of the recording head. The second surface of the recording head is a surface of the recording head on an opposite side from the first surface.

An inkjet recording apparatus according to an aspect of the present disclosure includes the head assembly and an installation base. The head assembly is installed in the installation base.

DETAILED DESCRIPTION

Figure 1:
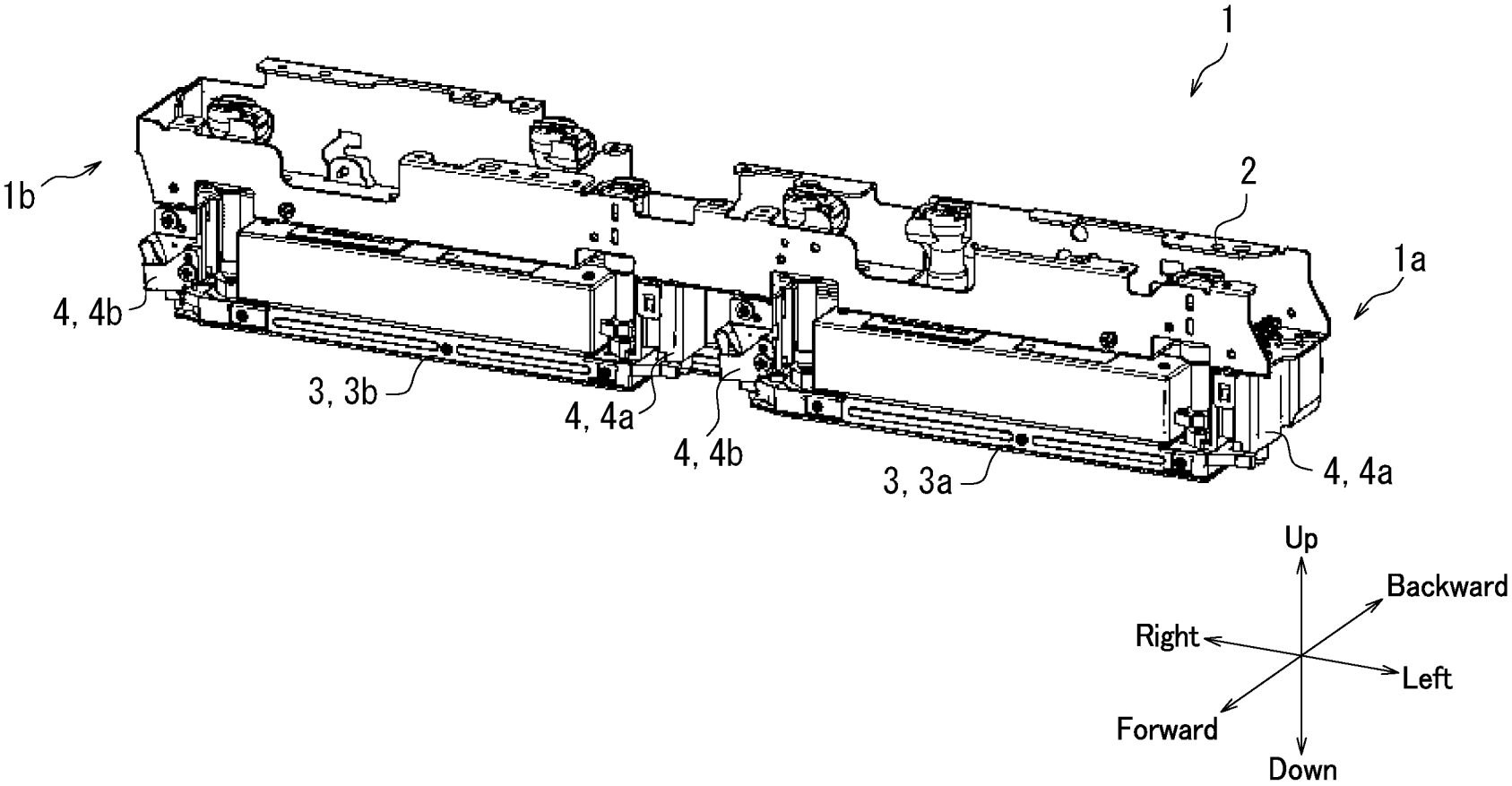
FIG. 1 is a perspective view of a head assembly according to an embodiment of the present disclosure.

Hereinafter, a head assembly according to an embodiment of the present disclosure will be described with reference to FIGS. 1 to 8, and an inkjet recording apparatus according to an embodiment of the present disclosure will be described with FIGS. 1 to 10. Elements that are the same or equivalent are indicated by the same reference signs in the drawings and description thereof is not repeated. In addition, overlapping description may be omitted as appropriate. Although a front-back direction, a vertical direction, and a left-right direction are described for easy understanding in the drawings, there is no intention to limit these directions as respective directions of a head assembly and an inkjet recording apparatus, when they are manufactured or used, according to an aspect of the present disclosure.

A head assembly 1 according to an embodiment will first be described with reference to FIG. 1. FIG. 1 is a perspective view of the head assembly 1 according to the present embodiment. Specifically, FIG. 1 illustrates the head assembly 1 as seen diagonally from above front left. As illustrated in FIG. 1, the head assembly 1 includes a base member 2, recording heads 3, and coupling members 4.

The head assembly 1 is an elongated component and includes a first end 1*a* and a second end 1*b* on an opposite side from the first end 1*a*. The first end 1*a* is one end of the head assembly 1 in a longitudinal direction thereof, while the second end 1*b* is the other end of the head assembly 1 in the longitudinal direction. In the present embodiment, the first end 1*a* of the head assembly 1 is a left end thereof and the second end 1*b* of the head assembly 1 is a right end thereof.

The coupling members 4 couple the recording heads 3 to the base member 2. The base member 2 is an elongated member. In the present embodiment, the recording heads 3 include a first recording head 3*a* and a second recording head 3*b*. The head assembly 1 according to the present embodiment includes two coupling members 4 for each of the recording heads 3. The two coupling members 4 include a first coupling member 4*a* and a second coupling member 4*b*. The first coupling member 4*a* is located at a left side of a corresponding recording head 3 to couple a left end of the corresponding recording head 3 to the base member 2. The second coupling member 4*b* is located at a right side of the corresponding recording head 3 to couple a right end of the corresponding recording head 3 to the base member 2. In the present embodiment, a side of the base member 2 on which the recording heads 3 are mounted is a lower side of the base member 2, while the other side is an upper side thereof.

Figure 2:
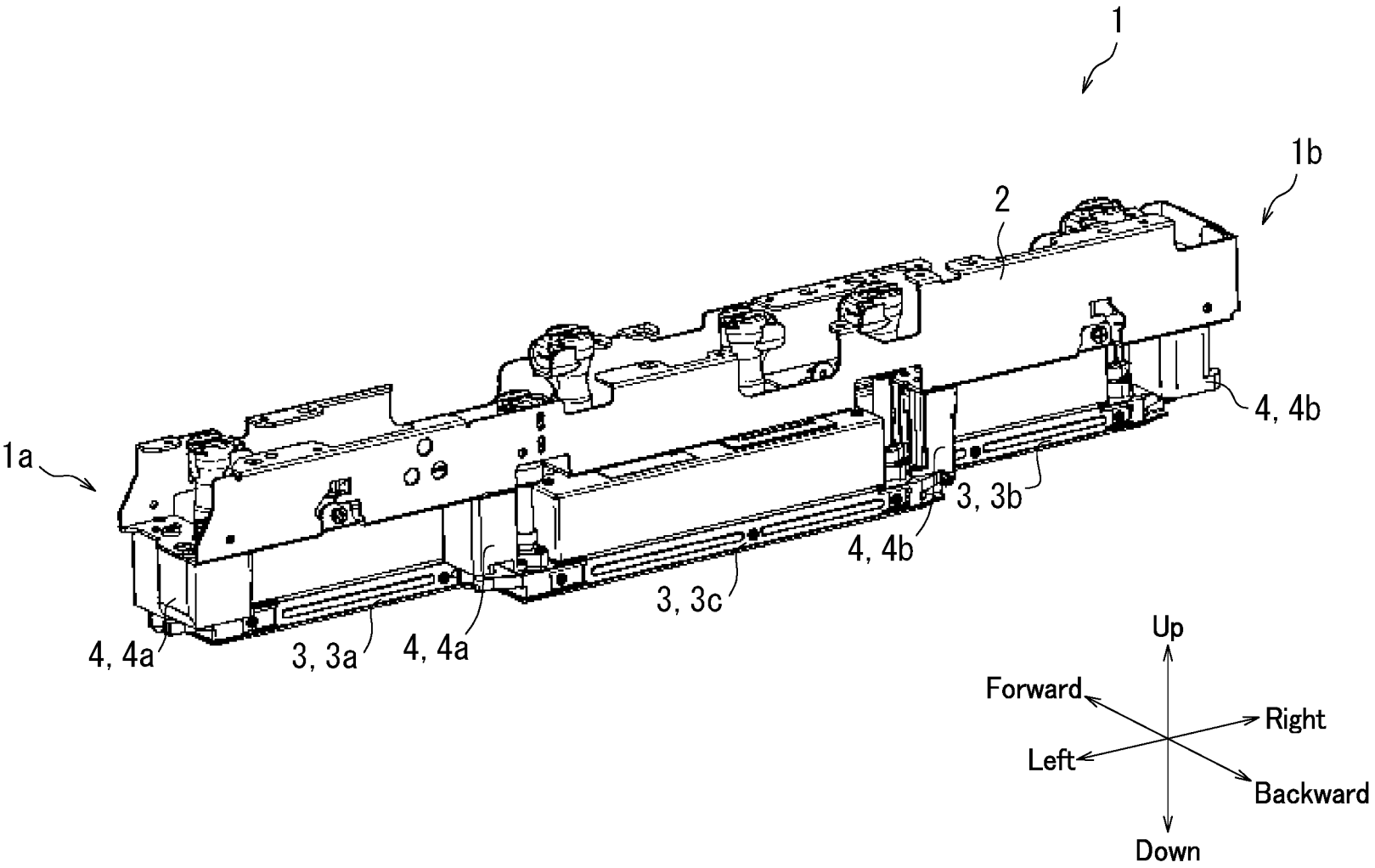
FIG. 2 is a perspective view of the head assembly according to the embodiment of the present disclosure.

The head assembly 1 according to the present embodiment will next be described with reference to FIG. 2. FIG. 2 is a perspective view of the head assembly 1 according to the present embodiment. Specifically, FIG. 2 illustrates the head assembly 1 as seen diagonally from above back left. As illustrated in FIG. 2, the recording heads 3 further include a third recording head 3*c*. That is, the head assembly 1 according to the present embodiment includes 3 recording heads 3.

In the present embodiment, the first recording head 3*a* is located at a side of a first end 1*a* of the head assembly 1. The second recording head 3*b* is located at a side of a second end 1*b* of the head assembly 1. The third recording head 3*c* is located at a center portion of the head assembly 1. The first to third recording heads 3*a* to 3*c* are mounted on a base member 2 in a staggered pattern in a longitudinal direction of the base member 2. Specifically, the third recording head 3*c* is set further back than the first and second recording heads 3*a* and 3*b*.

Figure 3:
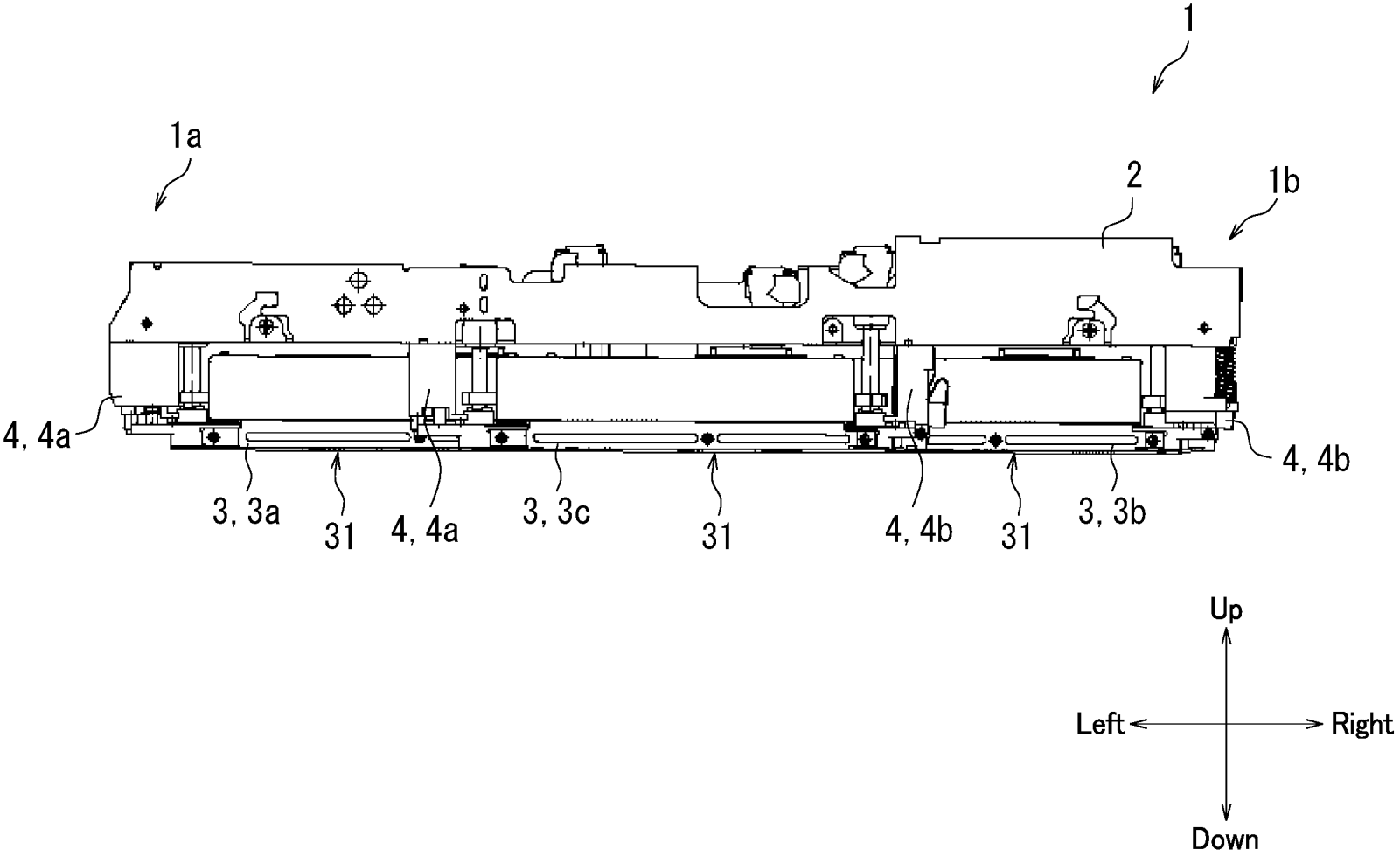
FIG. 3 is a rear view of the head assembly according to the embodiment of the present disclosure.
Figure 4:
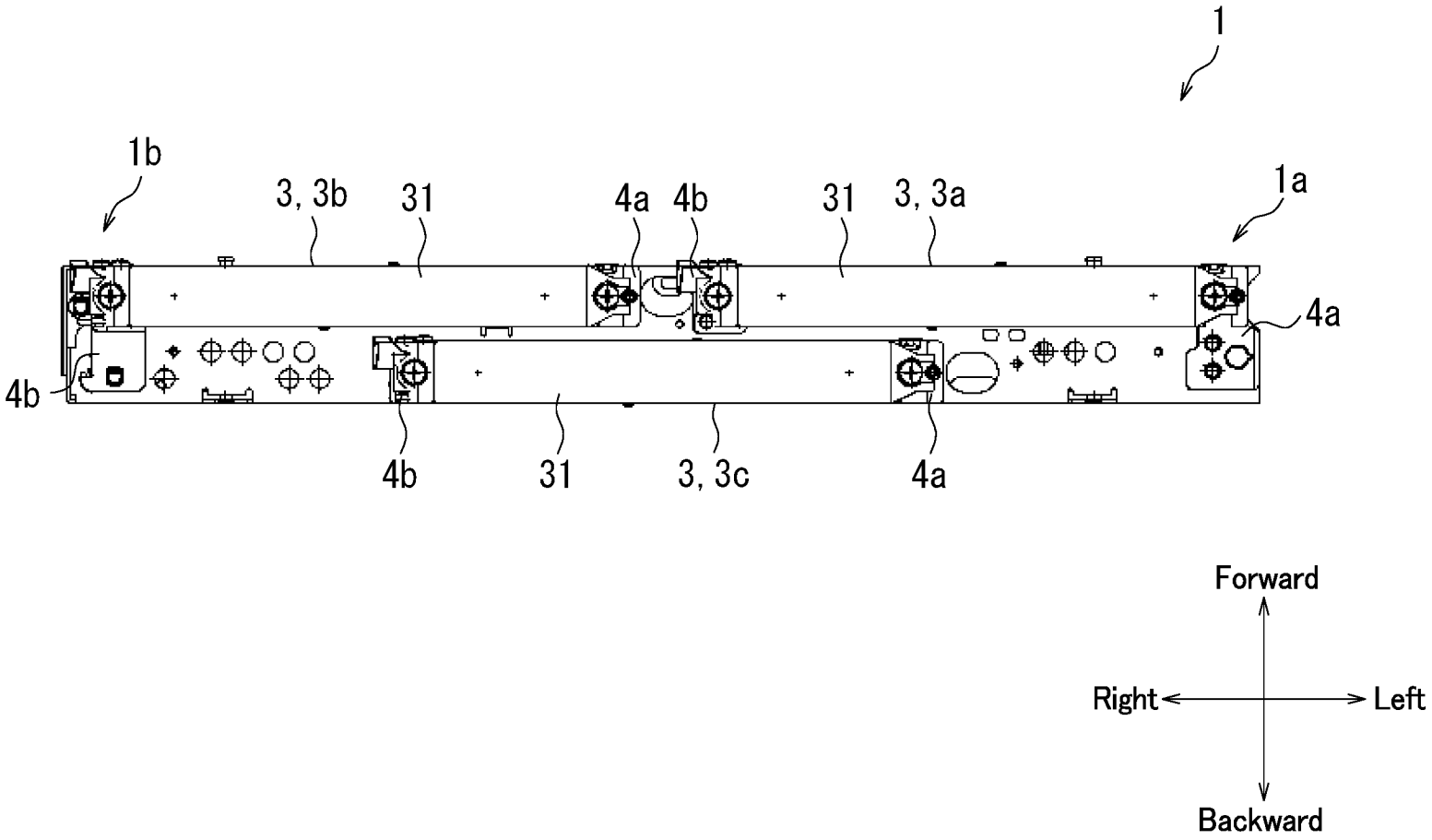
FIG. 4 is a bottom view of the head assembly according to the embodiment of the present disclosure.

The head assembly 1 according to the present embodiment will next be described with reference to FIGS. 3 and 4. FIG. 3 is a rear view of the head assembly 1 according to the present embodiment. FIG. 4 is a bottom view of the head assembly 1 according to the present embodiment.

As illustrated in FIGS. 3 and 4, the present embodiment includes 3 recording heads 3, each of which includes a nozzle surface 31. Ink is ejected from each of the nozzle surfaces 31 of the recording heads 3. Specifically, multiple nozzle orifices are formed in each of the nozzle surfaces 31 and ink is ejected from each of the nozzle orifices. Each nozzle surface 31 forms at least part of a lower surface (bottom surface) of a corresponding recording head 3. Each recording head 3 extends in a left-right direction as illustrated in FIG. 4. In other words, each recording head 3 extends in a longitudinal direction of the head assembly 1. Note that the first to third recording heads 3*a* to 3*c* eject ink of the same color.

Figure 5:
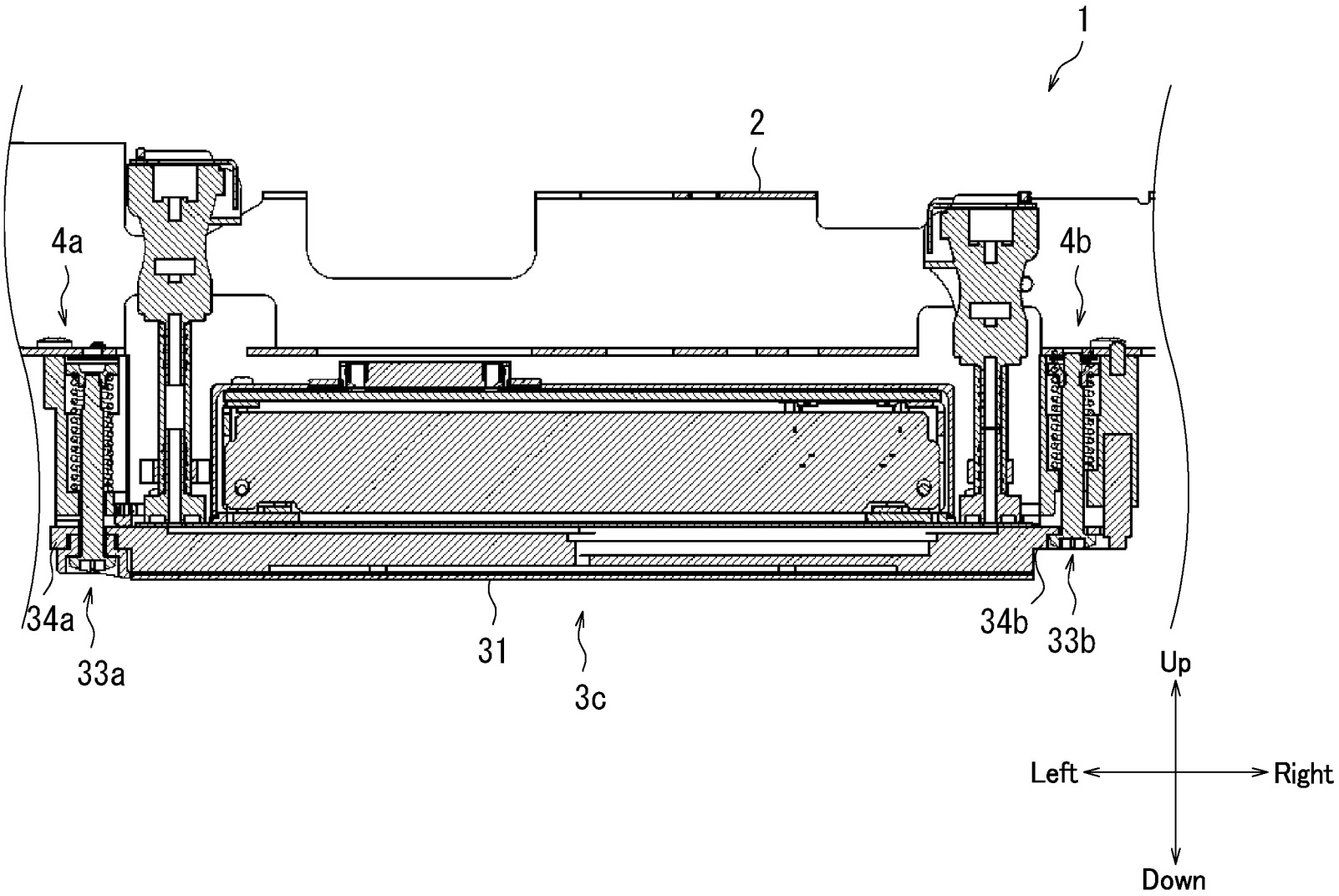
FIG. 5 is a sectional view of the head assembly according to the embodiment of the present disclosure.

The head assembly 1 according to the present embodiment will next be described with reference to FIG. 5. FIG. 5 is a sectional view of the head assembly 1 according to the present embodiment. Specifically, FIG. 5 illustrates a third recording head 3*c*, and first and second coupling members 4*a* and 4*b* that couple the third recording head 3*c* to a base member 2.

As illustrated in FIG. 5, the third recording head 3*c* includes a first end 33*a* and a second end 33*b* on an opposite side from the first end 33*a*. The first end 33*a* is a left end of the third recording head 3*c*, and the second end 33*b* is a right end of the third recording head 3*c*. Note that each of first and second recording heads 3*a* and 3*b* includes first and second ends 33*a* and 33*b* like the third recording head 3*c*.

In the present embodiment, the first end 33*a* of the third recording head 3*c* includes a first extension part 34*a* and the second end 33*b* of the third recording head 3*c* includes a second extension part 34*b*. The first and second extension parts 34*a* and 34*b* are located outside a nozzle surface 31 of the third recording head 3*c*. Specifically, the first extension part 34*a* is located on the left of the nozzle surface 31. The second extension part 34*b* is located on the right of the nozzle surface 31. Note that each of the first and second recording heads 3*a* and 3*b* includes first and second extension parts 34*a* and 34*b* like the third recording head 3*c*.

Figure 6:
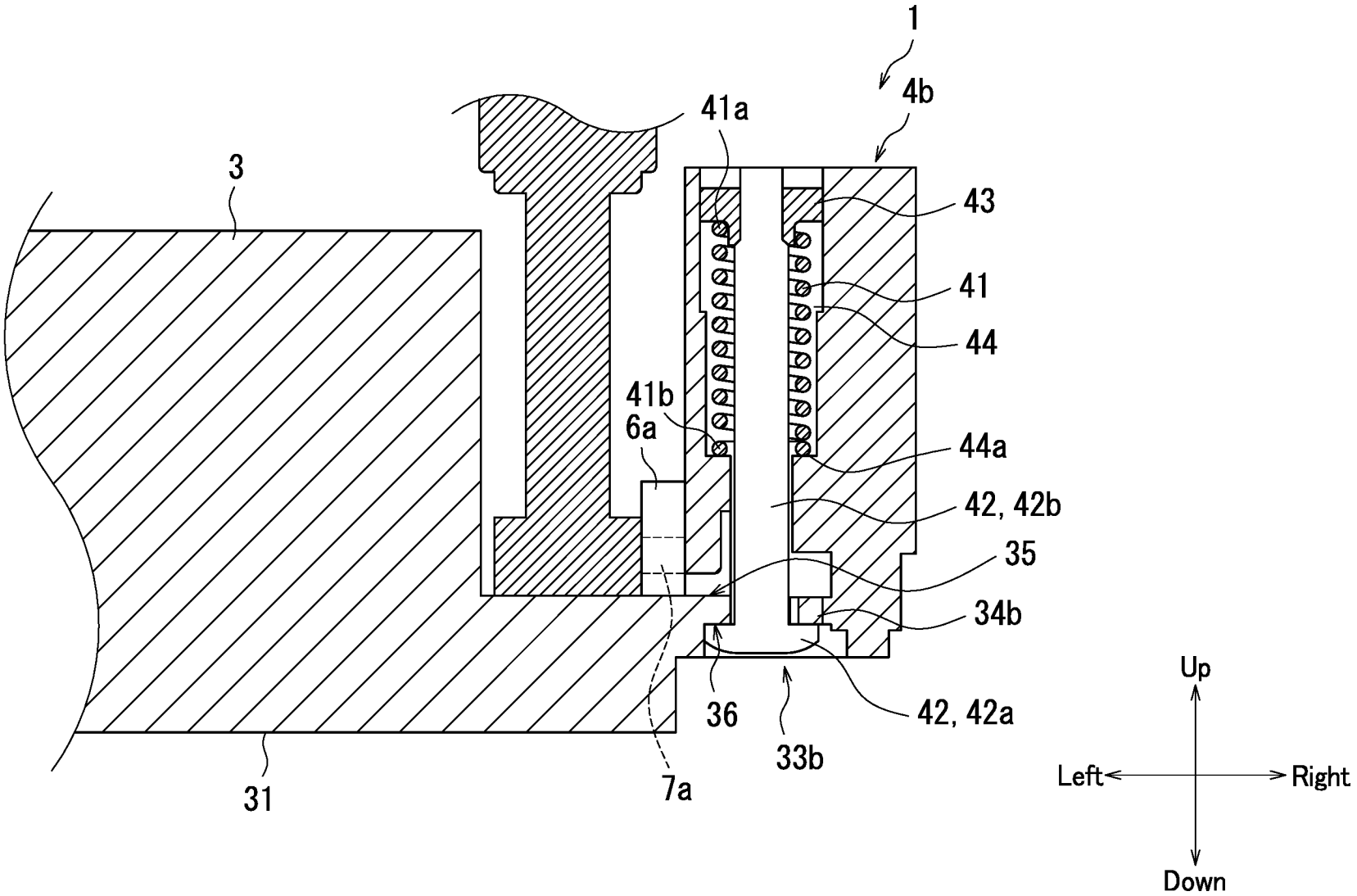
FIG. 6 is a sectional view of the head assembly according to the embodiment of the present disclosure.

Next, the head assembly 1 according to the present embodiment will further be described with reference to FIG. 6. FIG. 6 is a sectional view of the head assembly 1 according to the present embodiment. Specifically, FIG. 6 illustrates the second end 33*b* of one recording head 3 and a neighborhood of the second end 33*b*.

As illustrated in FIG. 6, the head assembly 1 further includes a first pressing member 6*a* and a first support part 7*a*. The first pressing member 6*a* is in contact with an upper surface of the recording head 3. In the present embodiment, the first pressing member 6*a* is in contact with an upper surface of the second extension part 34*b* of the recording head 3. The first support part 7*a* supports the first pressing member 6*a* and allows the first pressing member 6*a* to be moved relative to the first support part 7*a* in the vertical direction. The upper surface of the recording head 3 corresponds to a first surface of a recording head in an aspect of the present disclosure. In addition, the upper surface 35 of the second extension part 34*b* corresponds to a first surface of an extension part in an aspect of the present disclosure.

As illustrated in FIG. 6, the second coupling member 4*b* includes an urging member 41. The urging member 41 urges the lower surface of the recording head 3 toward the upper surface of the recording head 3. In the present embodiment, the urging member 41 urges a lower surface 36 of the second extension part 34*b* toward the upper surface 35 of the second extension part 34*b*. In other words, the urging member 41 urges the second end 33*b* of the recording head 3 upward. The urging member 41 includes for example a spring member. The lower surface of the recording head 3 corresponds to a second surface of the recording head in an aspect of the present disclosure. In addition, the lower surface 36 of the second extension part 34*b* corresponds to a second surface of the extension part in an aspect of the present disclosure.

The head assemblies 1 according to the embodiments have been described above with reference to FIGS. 1 and 6. Returning to FIG. 6, in the embodiment, the urging member 41 urges the recording head 3 upward with the first pressing member 6*a* being in contact with the upper surface of the recording head 3. This enables a worker to make height adjustment of the recording head 3 by adjusting the position of the first pressing member 6*a* in the vertical direction. In the present embodiment, it is therefore possible to make height adjustment of the first to third recording heads 3*a* to 3*c* to make respective nozzle surfaces 31 of the first to third recording heads 3*a* to 3*c* parallel to one another. Specifically, it is possible to make the respective nozzle surfaces 31 of the first to third recording heads 3*a* to 3*c* parallel relative to a conveyance surface which is just below the first to third recording heads 3*a* to 3*c* and which allows a recording medium to be conveyed thereon.

Next, the first pressing member 6*a* and the first support part 7*a* in the present embodiment will further be described with reference to FIG. 6. The first support part 7*a* is supported by the second coupling member 4*b*. The first support part 7*a* has a through hole that extends in the vertical direction. The through hole is a tapped hole and the first pressing member 6*a* is inserted into the through hole. Specifically, a thread groove is formed in a surface of the first pressing member 6*a* and the first pressing member 6*a* is screwed into the through hole of the first support part 7*a*. The first pressing member 6*a* is for example a set or grub screw.

The embodiment enables the worker to move the first pressing member 6*a* in the vertical direction by rotating the first pressing member 6*a*. In other words, the embodiment enables the worker to change a protrusion length of the first pressing member 6*a* from the first support part 7*a* by rotating the first pressing member 6*a*. Here, the protrusion length represents the length of the first pressing member 6*a* protruding from the first support part 7*a* toward the second extension part 34*b*. When the protrusion length of the first pressing member 6*a* protruding from the first support part 7*a* is increased, the first pressing member 6*a* pushes the second extension part 34*b* downward, thereby moving the second end 33*b* of the recording head 3 downward. In contrast, when the protrusion length of the first pressing member 6*a* protruding from the first support part 7*a* is decreased, the second end 33*b* of the recording head 3 receiving urging force of the urging member 41 moves upward following the movement of the first pressing member 6*a*.

Next, the second coupling member 4*b* in the present embodiment will further be described with reference to FIG. 6. As illustrated in FIG. 6, the second coupling member 4*b* further includes a penetration member 42 and a stopper 43.

The penetration member 42 penetrates the second extension part 34*b*. The penetration member 42 includes a flange 42*a* and a shaft 42*b*. The flange 42*a* is in contact with the lower surface 36 of the second extension part 34*b*. The shaft 42*b* is connected to the flange 42*a*. The shaft 42*b* protrudes upward from the flange 42*a*. Specifically, the shaft 42*b* penetrates the second extension part 34*b* and protrudes from the upper surface 35 of the second extension part 34*b*.

The stopper 43 is fixed to the penetration member 42. Specifically, the stopper 43 is fixed to, of the shaft 42*b*, part protruding from the upper surface 35 of the second extension part 34*b*. In other words, the stopper 43 is placed above the second extension part 34*b*. In the present embodiment, the stopper 43 is fixed to a tip end of the shaft 42*b*. Here, the tip end of the shaft 42*b* is an end of the shaft 42*b* on an opposite side from the flange 42*a*. The penetration member 42 is for example a pin member. A thread groove is formed in a surface of a tip end of the penetration member 42. The stopper 43 is for example a nut.

The urging member 41 is placed beneath the stopper 43 and urges the stopper 43 upward. The urging member 41 is also placed above the second extension part 34*b*. In other words, the urging member 41 is located at the opposite side of the recording head 3 from the nozzle surface 31. Thus, in the present embodiment, the urging member 41 is placed in a position that prevents the urging member 41 from interfering with a recording medium being conveyed directly below the nozzle surface 31.

More specifically, as illustrated in FIG. 6, the second coupling member 4*b* includes an insertion hole 44 elongated in the vertical direction. The insertion hole 44 has an opening formed in a lower surface thereof. The shaft 42*b* of the penetration member 42 is inserted into the insertion hole 44 from the lower surface (opening) of the insertion hole 44.

The insertion hole 44 includes a step (rise-height part) 44*a*. Specifically, the second coupling member 4*b* includes an inner surface that forms the insertion hole 44 and that includes a protrusion protruding toward a center of the insertion hole 44. An upper end face of the protrusion forms the step 44*a*. Therefore, a diameter of the insertion hole 44 changes on both sides of the step 44*a*. Specifically, a diameter of the insertion hole 44 on the upper side of the step 44*a* is larger than a diameter of the insertion hole 44 on the lower side of the step 44*a*.

The stopper 43 and the urging member 41 are disposed in the insertion hole 44. Specifically, the stopper 43 and the urging member 41 are disposed in a portion of the insertion hole 44 on the upper side of the step 44*a*. The stopper 43 disposed in the insertion hole 44 is movable in the vertical direction. The urging member 41 disposed in the insertion hole 44 is allowed to be compressed and stretched.

The urging member 41 includes a first end 41*a* and a second end 41*b* on an opposite side from the first end 41*a*. In the present embodiment, the first end 41*a* is an upper end of the urging member 41 and the second end 41*b* is a lower end of the urging member 41.

The first end 41*a* of the urging member 41 is connected to the stopper 43. Specifically, the first end 41*a* of the urging member 41 is connected to a lower surface of the stopper 43. The second end 41*b* of the urging member 41 is connected to the step 44*a*. Note that the first end 41*a* of the urging member 41 may be in contact with the stopper 43 or fixed to the stopper 43. Similarly, the second end 41*b* of the urging member 41 may be in contact with the step 44*a* or fixed to the step 44*a*.

The second coupling member 4*b* has been described above with reference to FIG. 6. The present embodiment enables the second coupling member 4*b* to support the second end 33*b* of the recording head 3 with the second end 33*b* receiving urging force of the urging member 41 being movable in the vertical direction. It is therefore possible to move the second end 33*b* of the recording head 3 in the vertical direction by changing the protrusion length of the first pressing member 6*a* protruding from the first support part 7*a*.

Figure 7:
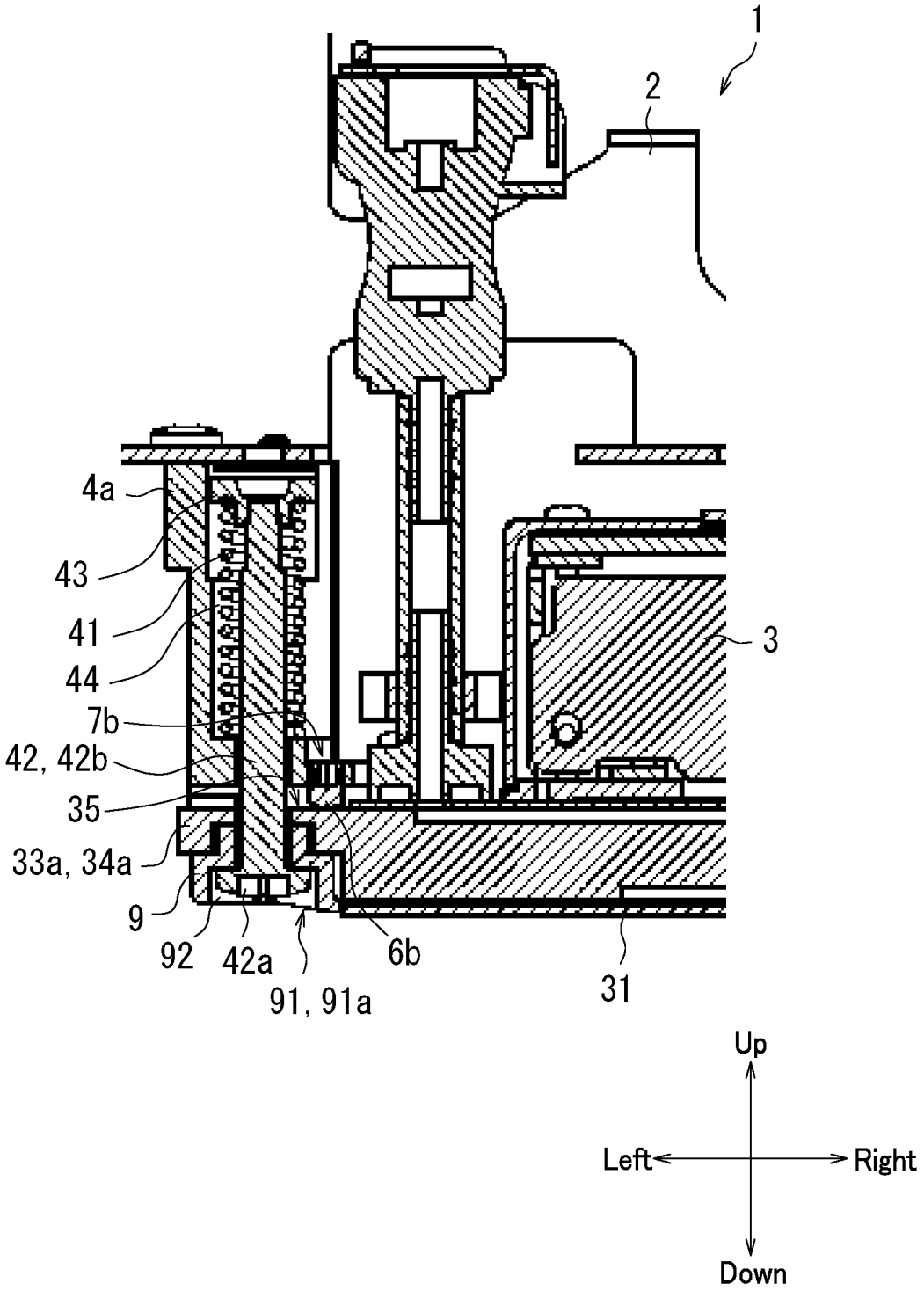
FIG. 7 is a sectional view of the head assembly according to the embodiment of the present disclosure.

Next, the head assembly 1 according to the present embodiment will further be described with reference to FIG. 7. FIG. 7 is a sectional view of the head assembly 1 according to the present embodiment. Specifically, FIG. 7 illustrates the first end 33*a* of the recording head 3 and a neighborhood of the first end 33*a*.

As illustrated in FIG. 7, the head assembly 1 further includes a second pressing member 6*b* and a second support part 7*b*. The second pressing member 6*b* has the same structure as that of the first pressing member 6*a* described with reference to FIG. 6. That is, the second pressing member 6*b* is in contact with the upper surface of the recording head 3 like the first pressing member 6*a*. In the present embodiment, the second pressing member 6*b* is in contact with an upper surface 35 of the first extension part 34*a* of the recording head 3. The second support part 7*b* has the same structure as that of the first support part 7*a* described with reference to FIG. 6. That is, the second support part 7*b* supports the second pressing member 6*b* and allows the second pressing member 6*b* to be moved relative to the second support part 7*b* in the vertical direction. Note that the upper surface 35 of the first extension part 34*a* corresponds to the first surface of the extension part in an aspect of the present disclosure like the upper surface 35 of the second extension part 34*b*.

As illustrated in FIG. 7, the first coupling member 4*a* has the same structure as that of the second coupling member 4*b* described with reference to FIG. 6. That is, the first coupling member 4*a* includes an urging member 41, a penetration member 42, a stopper 43, and an insertion hole 44 like those of the second coupling member 4*b*.

The head assembly 1 according to the present embodiments has been described above with reference to FIG. 7. The present embodiment enables the worker to move the first end 33*a* of the recording head 3 in the vertical direction by changing a vertical position of the second pressing member 6*b*. This enables the worker to make height adjustment of the recording head 3 by adjusting respective vertical positions of the first and second pressing members 6*a* and 6*b*.

Next, the head assembly 1 according to the present embodiment will further be described with reference to FIG. 7. As illustrated in FIG. 7, the head assembly 1 further includes a protective member 9. The protective member 9 is placed at the first end 33*a* of the recording head 3. Specifically, the protective member 9 is interposed between a flange 42*a* of the penetration member 42 and the first extension part 34*a*.

More specifically, the protective member 9 includes a recess 92 recessed upward from a lower surface 91 of the protective member 9. The flange 42*a* of the penetration member 42 is disposed in the recess 92. The lower surface 91 of the protective member 9 includes a slope 91*a* inclined relative to the nozzle surface 31. The slope 91*a* is connected to the nozzle surface 31. In the present embodiment, the slope 91*a* is connected to a left end of the nozzle surface 31. The slope 91*a* is an upward slope that is inclined upward from a side closer to the nozzle surface 31 to a side farther from the nozzle surface 31.

The protective member 9 has been described above with reference to FIG. 7. The head assembly 1 according to the present embodiment includes the protective member 9, thereby making it difficult that when a wiper blade 142*a* to be described with reference to FIG. 10 cleans the nozzle surface 31, ink wiped off from the nozzle surface 31 by the wiper blade 142*a* scatters.

Specifically, the wiper blade 142*a* moves from the right end to the left end of the nozzle surface 31 with the wiper blade 142*a* being in contact with the nozzle surface 31. Because material of the wiper blade 142*a* has elasticity, the wiper blade 142*a* is brought into a bent state as a result of the wiper blade 142*a* being pressed against the nozzle surface 31 when the nozzle surface 31 is cleaned by the wiper blade 142*a*. In this case, when a step exists at the left end of the nozzle surface 31, the ink wiped off from the nozzle surface 31 by the wiper blade 142*a* is to scatter by reaction force of the wiper blade 142*a* returning to an original posture from a bent posture of the wiper blade 142*a*. In contrast, since the slope 91*a* is connected to the left end of the nozzle surface 31 in the present embodiment, the wiper blade 142*a* is to gently return to the original posture from the bent posture. The ink is consequently less likely to scatter.

In the present embodiment, the flange 42*a* of the penetration member 42 is disposed in the recess 92. This makes it possible to prevent the wiper blade 142*a* from coming into contact with the flange 42*a*. As a result, it is possible to prevent the wiper blade 142*a* from being damaged by the flange 42*a*.

Figure 8:
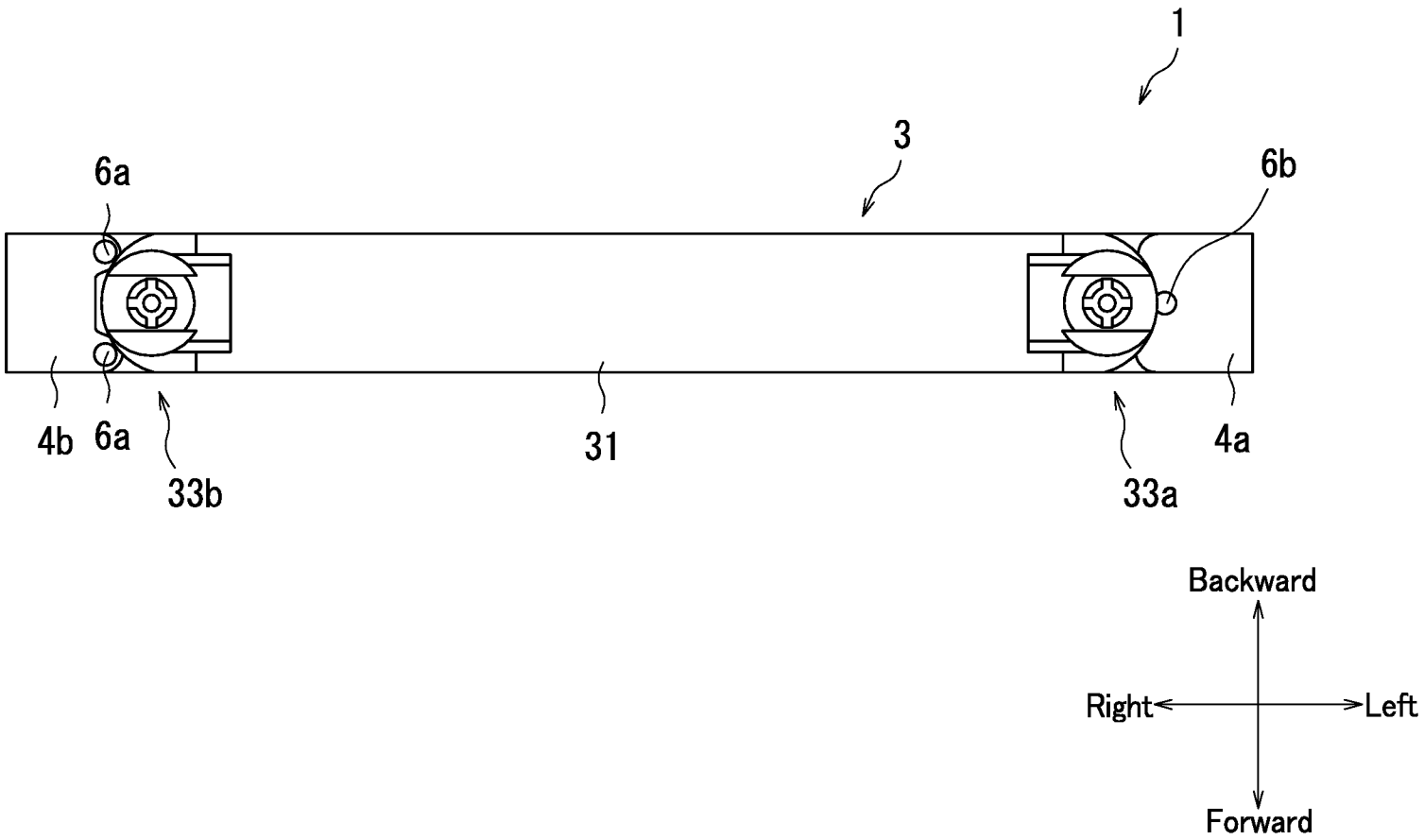
FIG. 8 is a top view illustrating a recording head, a first coupling member, and a second coupling member in the embodiment of the present disclosure.

Next, the head assembly 1 according to the present embodiment will further be described with reference to FIG. 8. FIG. 8 is a top view illustrating the recording head 3, the first coupling member 4*a*, and the second coupling member 4*b* in the present embodiment.

As illustrated in FIG. 8, the head assembly 1 includes two first pressing members 6*a* and one second pressing member 6*b*. This therefore enables the worker to make height adjustment of the recording head 3 at three locations on the recording head 3. This consequently facilitates work of making respective nozzle surfaces 31 of the first to third recording heads 3*a* to 3*c* parallel relative to the conveyance surface which allows the recording medium to be conveyed thereon.

Figure 9:
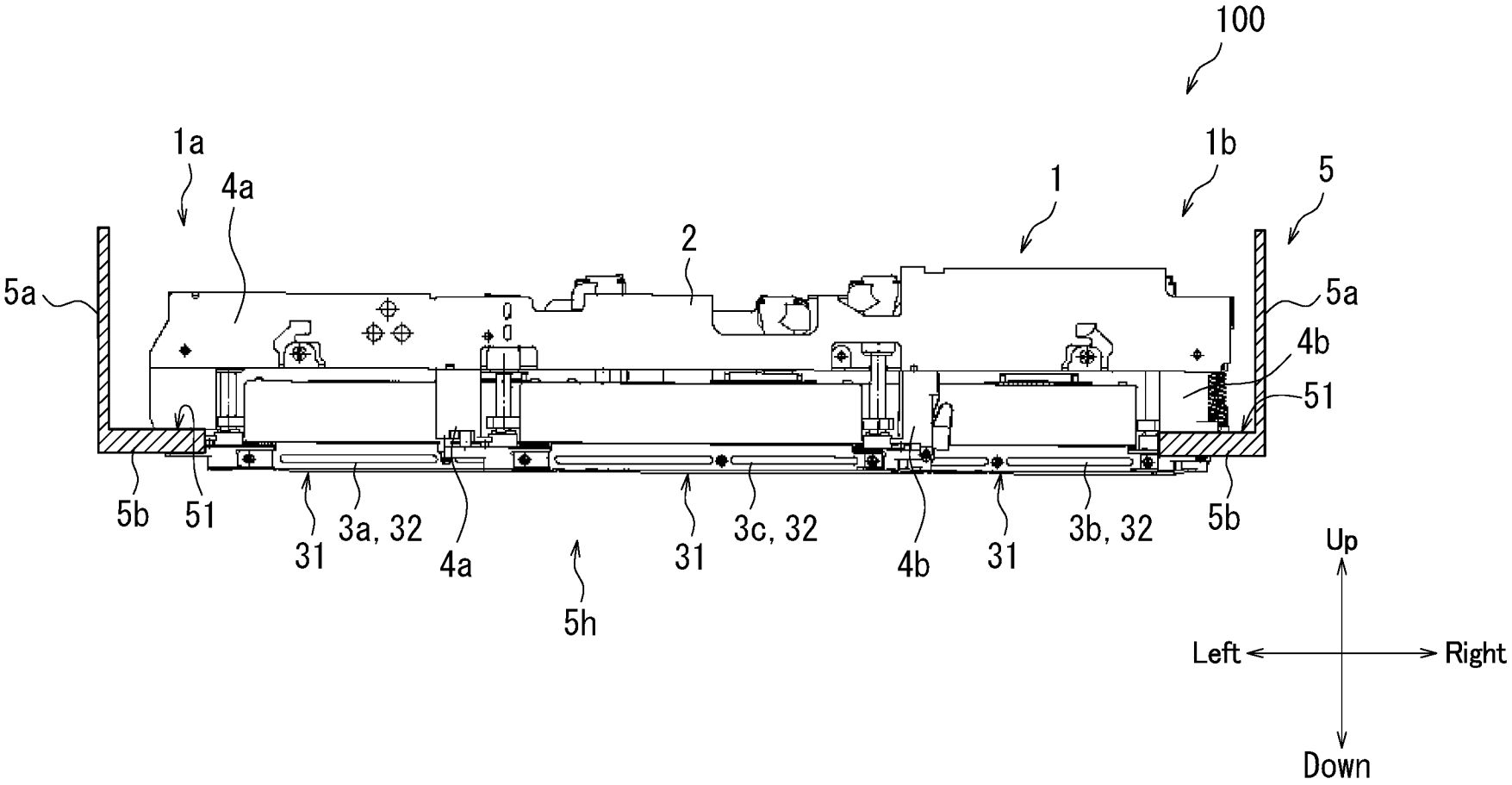
FIG. 9 illustrates an inkjet recording apparatus according to an embodiment of the present disclosure.

Next, an inkjet recording apparatus 100 according to an embodiment will be described with reference to FIG. 9. FIG. 9 illustrates the inkjet recording apparatus 100 according to the present embodiment. As illustrated in FIG. 9, the inkjet recording apparatus 100 includes a head assembly 1 and an installation base 5.

The head assembly 1 is installed in the installation base 5. The installation base 5 includes for example a frame body with an opening formed in an upper surface thereof. In this case, the installation base 5 houses the head assembly 1. The installation base 5 is supported by a body frame provided for the inkjet recording apparatus 100.

The installation base 5 includes side walls 5*a* and a bottom wall 5*b*. The side walls 5*a* are connected to respective ends of the bottom wall 5*b* and extend upward from the bottom wall 5*b*. The bottom wall 5*b* includes an opening 5*h* and a loading surface 5*l*. The head assembly 1 is installed in the installation base 5 with part of a lower surface of the head assembly 1 mounted on the loading surface 5*l*. When the head assembly 1 is installed in the installation base 5, respective lower ends 32 (ends on each nozzle surface side) of the first to third recording heads 3*a* to 3*c* protrude from the opening 5*h*. The respective nozzle surfaces 31 of the first to third recording heads 3*a* to 3*c* are consequently positioned below the bottom wall 5*b* of the installation base 5.

Figure 10:
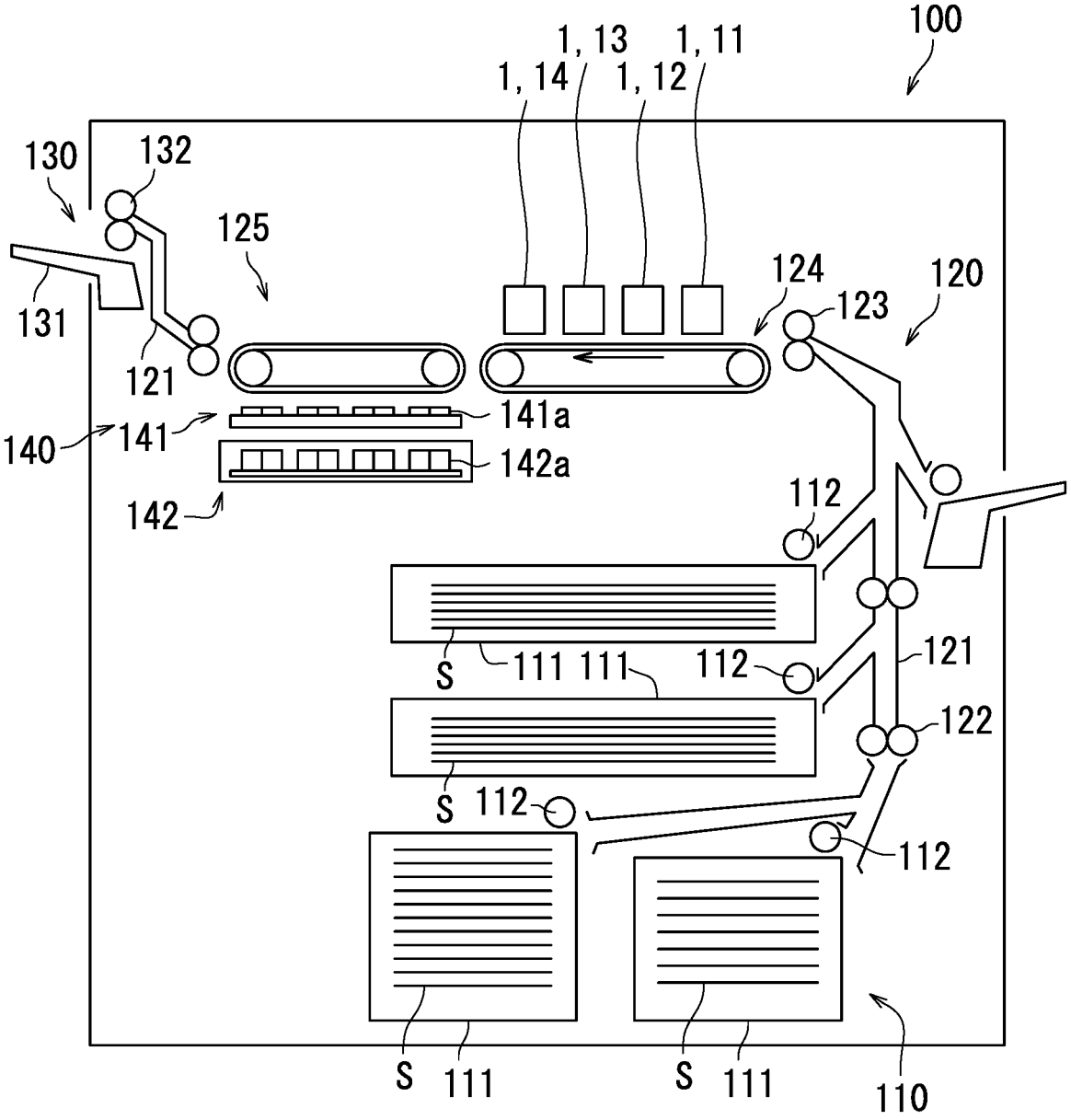
FIG. 10 illustrates a configuration of the inkjet recording apparatus according to the embodiment of the present disclosure.

Next, the inkjet recording apparatus 100 according to the present embodiment will further be described with reference to FIG. 10. FIG. 10 illustrates a configuration of the inkjet recording apparatus 100 according to the present embodiment.

As illustrated in FIG. 10, the inkjet recording apparatus 100 includes a feeding section 110, a sheet conveyance section 120, an ejection section 130, and a maintenance unit 140. In addition, the inkjet recording apparatus 100 includes four head assemblies 1. The four head assemblies 1 include a first head assembly 11, a second head assembly 12, a third head assembly 13, and a fourth head assembly 14.

The feeding section 110 feeds a sheet S to the sheet conveyance section 120. The feeding section 110 in the present embodiment includes housing cassettes 111 and feeding rollers 112. Each of the housing cassettes 111 houses therein at least one sheer S. Each of the feeding rollers 112 feeds a sheet S from a corresponding housing cassette 111 to the sheet conveyance section 120. Note that the sheet S is an example of a recording medium.

The sheet conveyance section 120 conveys a sheet S from each of the housing cassettes 111 to the ejection section 130. Specifically, the sheet conveyance section 120 includes conveyance guides 121, conveyance roller pairs 122, and a registration roller pair 123. The conveyance guides 121 constitute a conveyance path of the sheet S. The conveyance roller pairs 122 convey the sheet S along the conveyance path. The registration roller pair 123 adjusts conveyance timing of the sheet S to an area facing the first to fourth head assemblies 11 to 14.

The sheet conveyance section 120 in the present embodiment includes a first conveyance unit 124 and a second conveyance unit 125. The first conveyance unit 124 faces the first to fourth head assemblies 11 to 14. The first conveyance unit 124 conveys the sheet S in an area directly under the first to fourth head assemblies 11 to 14. The first conveyance unit 124 forms a conveyance surface which is an area just below the first to fourth head assemblies 11 to 14 and which allows the sheet S to be conveyed thereon. The second conveyance unit 125 conveys the sheet S sent out from the first conveyance unit 124 toward the ejection section 130.

The three recording heads 3 provided for each of the first to fourth head assemblies 11 to 14 eject ink to the sheet S being conveyed by the first conveyance unit 124. Specifically, the first to fourth head assemblies 11 to 14 eject ink of different colors. For example, the three recording heads 3 of the first head assembly 11 eject black ink. The three recording heads 3 of the second head assembly 12 eject cyan ink. The three recording heads 3 of the third head assembly 13 eject magenta ink. The three recording heads 3 of the fourth head assembly 14 eject yellow ink.

The ejection section 130 ejects the sheet S to an outside of the inkjet recording apparatus 100. The ejection section 130 in the present embodiment includes an exit tray 131 and an ejection roller pair 132. The ejection roller pair 132 ejects the sheet S onto the exit tray 131.

The maintenance unit 140 performs maintenance of the three recording heads 3 for each of the first to fourth head assemblies 11 to 14. The maintenance unit 140 is placed below the second conveyance unit 125 when an image is recorded on the sheet S, and is moved to a location directly below the first to fourth head assemblies 11 to 14 during maintenance of the recording heads 3. Note that the first conveyance unit 124 is placed in a retraction position thereof during the maintenance of the recording heads 3. The retraction position is a position where the first conveyance unit 124 is prevented from colliding with the maintenance unit 140.

The maintenance unit 140 in the present embodiment includes a cap section 141 and a cleaning section 142. As described with reference to FIG. 3, each recording head 3 includes its own nozzle surface 31. The cap section 141 includes 12 capping members 141*a*. Each nozzle surface 31 of the three recording heads 3 for each head assembly 1 is capped with a corresponding capping member 141*a* of the 12 capping members 141*a*. Thus, the 12 capping members 141*a* provide an environment where ink is less likely to dry.

The cleaning section 142 cleans the respective nozzle surfaces 31 of the recording heads 3. Specifically, the cleaning section 142 includes 12 wiper blades 142*a*. Material examples of each wiper blade 142*a* include resin. Each wiper blade 142*a* is a cleaning member for cleaning a corresponding one of the nozzle surfaces 31.

The cleaning section 142 moves the wiper blades 142*a* in the longitudinal direction of the recording heads 3 described with reference to FIG. 5 with the wiper blades 142*a* being in contact with respective lower surfaces of the recording heads 3. Thus, the nozzle surfaces 31 are cleaned as a result of the nozzle surfaces 31 being wiped off by the wiper blades 142*a*. Specifically, ink adhering to each nozzle surface 31 is wiped off by a corresponding one of the wiper blades 142*a*.

In the present embodiment, the first head assembly 11 includes respective protective members 9 provided for the 3 recording heads 3 of the first head assembly 11 as described with reference to FIG. 7. Each of the second to fourth head assemblies 12 to 14 also includes protective members 9 thereof like those of the first head assembly 11. Therefore, ink wiped off from each nozzle surface 31 by a corresponding wiper blade 142*a* is less likely to scatter.

The embodiments of the present disclosure have been described above with reference to FIGS. 1 to 10. However, the present disclosure is not limited to the above embodiments and may be implemented in various manners within a scope not departing from the gist of the present disclosure. The components disclosed in the above embodiments can be changed as appropriate. The drawings schematically illustrate main elements of configuration to facilitate understanding thereof. Aspects of the elements of configuration illustrated in the drawings, such as thickness, length, number, and interval, may differ in practice for the sake of convenience for drawing preparation. Furthermore, aspects of the elements of configuration illustrated in the above embodiments are examples and are not particularly limited. The elements of configuration may be variously altered within a scope not substantially departing from the effects of the present disclosure.

For example, although the number of first pressing members 6*a* is two as described with reference to FIG. 8, the number of first pressing members 6*a* may be one, or three or more. In addition, although the number of second pressing members 6*b* is one as described with reference to FIG. 8, the number of second pressing members 6*b* may be two or more.

Although the head assembly 1 includes the first and second pressing members 6*a* and 6*b* in the embodiment of the present disclosure, the head assembly 1 may be only one of the first and second pressing members 6*a* and 6*b*.

Although a configuration that enables height adjustment of the 3 recording heads 3 of the head assembly 1 in the embodiment of the present disclosure, the head assembly 1 may be configured to enable height adjustment of one or two recording heads 3 of the 3 recording heads 3.

Although the inkjet recording apparatus 100 includes the four head assemblies 1 as described with reference to FIG. 10, the number of head assemblies 1 provided for the inkjet recording apparatus 100 may be one, two, three, or five or more.

Although the head assembly 1 includes 3 recording heads 3 as described with reference to FIGS. 2 to 4 and 10, the number of recording heads 3 provided for the head assembly 1 may be one, two, or four or more.

What is claimed is:

1. A head assembly, comprising:

a base member;

a recording head configured to eject ink;

a coupling member that couples the recording head to the base member; and a pressing member that is in contact with a first surface of the recording head, wherein the coupling member includes an urging member that urges a second surface of the recording head toward the first surface of the recording head, the second surface of the recording head is a surface of the recording head on an opposite side from the first surface, the recording head includes a nozzle surface in which nozzle orifices that allow ink to be ejected therefrom are formed, and an extension part that is placed outside the nozzle surface, the extension part includes a first surface and a second surface on an opposite side from the first surface, the first surface of the recording head includes the first surface of the extension part, the second surface of the recording head includes the second surface of the extension part, the pressing member is in contact with the first surface of the extension part, and the urging member urges the second surface of the extension part.

2. The head assembly according to claim 1, wherein the coupling member includes a penetration member that penetrates the extension part and a stopper fixed to the penetration member, the penetration member includes a flange that is in contact with the second surface of the extension part, and a shaft that is connected to the flange and that penetrates the extension part to protrude from the first surface of the extension part, the stopper is fixed to part of the shaft protruding from the first surface of the extension part, and the urging member urges the stopper.

3. The head assembly according to claim 2, further comprising a protective member that is interposed between the flange and the extension part, wherein the protective member includes a slope that is inclined relative to the nozzle surface.

4. The head assembly according to claim 2, wherein the coupling member includes an insertion hole into which the shaft is inserted, the stopper and the urging member are disposed in the insertion hole, the urging member includes a first end connected to the stopper and a second end on an opposite side from the first end, and the insertion hole includes a step connected to the second end of the urging member.

5. The head assembly according to claim 1, wherein the recording head includes a first end and a second end on an opposite side from the first end, and the coupling member includes a first coupling member that couples the first end of the recording head to the base member, and a second coupling member that couples the second end of the recording head to the base member.

6. The head assembly according to claim 5, comprising as the pressing member a plurality of pressing members that include a first pressing member located at a side of the first end of the recording head, and a second pressing member located at a side of the second end of the recording head.

7. The head assembly according to claim 6, wherein the pressing members include, as the first pressing member and the second pressing member, two first pressing members or one first pressing member and one second pressing member or two second pressing members, respectively.

8. An inkjet recording apparatus, comprising the head assembly according to claim 1, and an installation base in which the head assembly is installed.

9. A head assembly, comprising:

a base member;

a recording head configured to eject ink;

a coupling member that couples the recording head to the base member; and a pressing member that is in contact with a first surface of the recording head, wherein the coupling member includes an urging member that urges a second surface of the recording head toward the first surface of the recording head, the second surface of the recording head is a surface of the recording head on an opposite side from the first surface, the recording head includes a first end and a second end on an opposite side from the first end, and the coupling member includes a first coupling member that couples the first end of the recording head to the base member, and a second coupling member that couples the second end of the recording head to the base member.

10. The head assembly according to claim 9, comprising as the pressing member a plurality of pressing members that include a first pressing member located at a side of the first end of the recording head, and a second pressing member located at a side of the second end of the recording head.

11. The head assembly according to claim 10, wherein the pressing members include, as the first pressing member and the second pressing member, two first pressing members or one first pressing member and one second pressing member or two second pressing members, respectively.

12. An inkjet recording apparatus, comprising the head assembly according to claim 9, and an installation base in which the head assembly is installed.

* * * * *